US007259564B2

(12) United States Patent
Ligneul et al.

(10) Patent No.: US 7,259,564 B2
(45) Date of Patent: Aug. 21, 2007

(54) METHOD AND DEVICE FOR DETERMINING THE POSITION OF AN INTERFACE IN RELATION TO A BORE HOLE

(75) Inventors: Patrice Ligneul, Chaville (FR); Marwan Charara, Rueil Malmaison (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/530,503

(22) PCT Filed: Oct. 6, 2003

(86) PCT No.: PCT/EP03/11173

§ 371 (c)(1),
(2), (4) Date: Jan. 6, 2006

(87) PCT Pub. No.: WO2004/038177

PCT Pub. Date: May 6, 2004

(65) Prior Publication Data

US 2006/0119363 A1 Jun. 8, 2006

(30) Foreign Application Priority Data

Oct. 25, 2002 (FR) ..... 02 13370

(51) Int. Cl.
*G01V 3/12* (2006.01)

(52) U.S. Cl. ..... 324/337; 324/338; 324/355; 324/357

(58) Field of Classification Search ..... 324/337–338, 324/355, 357
See application file for complete search history.

(56) References Cited

U.S. PATENT DOCUMENTS

| | | | | |
|---|---|---|---|---|
| 4,760,340 | A * | 7/1988 | Denzau et al. | 324/348 |
| 4,968,940 | A * | 11/1990 | Clark et al. | 324/338 |
| 5,233,522 | A | 8/1993 | Sinclair | |
| 6,476,608 | B1 * | 11/2002 | Dong | 324/323 |
| 6,541,985 | B2 * | 4/2003 | Yankielun | 324/644 |
| 7,031,839 | B2 * | 4/2006 | Tabarovsky et al. | 702/7 |
| 2006/0192560 | A1 * | 8/2006 | Eiane et al. | 324/337 |

FOREIGN PATENT DOCUMENTS

| | | |
|---|---|---|
| FR | 2402188 A | 3/1979 |
| FR | 2613842 A | 10/1988 |
| GB | 2355477 A | 4/2001 |
| WO | WO 0000716 A | 1/2000 |

* cited by examiner

*Primary Examiner*—Jay M. Patidar
(74) *Attorney, Agent, or Firm*—Bryan L. White; Kevin P. McEnaney; Jaime Costaño

(57) ABSTRACT

The invention concerns a method for determining the position, in a formation (1) containing at least one electrolytic liquid, of an interface (6) in relation to a bore hole (2). One stimulates at a first instant the interface (6) with an excitation signal, one detects at a second instant (t2) a response signal converted by electro-osmosis or electrokinetic coupling effect and, if appropriate, the exication signal after reflection at a third instant (t3). With the three instants and the propagation velocity of the signals, one calculates the distance between the interface (6) and the bore hole (2).

28 Claims, 6 Drawing Sheets

METHOD AND DEVICE FOR DETERMINING THE POSITION OF AN INTERFACE IN RELATION TO A BORE HOLE

TECHNICAL FIELD

The present invention concerns a method and a device for determining the position of an interface in a geological formation in relation to a bore hole in the formation.

This type of method and this type of device are particularly suited to determining, around the bore hole, the profile of the zone of the geological formation invaded by bore fluid, as well as the profile of distributions of fractures along the bore hole. In the following description the expression geological formation is often simply called formation.

STATE OF THE PRIOR ART

When carrying out drilling operations in a geological formation, one uses a bore fluid (called the drilling mud). This is generally an aqueous or oily fluid which serves to cool down and lubricate the boring tool, to evacuate bore cuttings, to maintain the walls of the bore hole (or well) by the formation of a mud cake and to balance out, by its own weight, the pressure of the fluids such as water, gas and/or oil hydrocarbons contained within the formation crossed by the well. The mud cake corresponds to the deposition that the solid elements of the bore fluid form on the walls of the bore hole after the absorption of the fluid by the formation.

Said bore fluid invades a zone situated around the bore hole and the depth of penetration depends on several factors, particularly the nature of the mud cake and the permeability and porosity of the surrounding formation. An impedance break exists at the interface between the invaded zone and the non-invaded zone.

The characteristics of the invaded zone are important for determining the physical parameters of the formation and different-methods may be used to acquire said characteristics. Said characteristics make it possible, in particular, to evaluate the behaviour and the producing capacity of the formation. They enable, for example, a correction to be made to density measurements carried out by neutronic emission. Certain aspects of calibration measurements carried out by nuclear magnetic resonance may benefit from these characteristics.

The profile of the invaded zone that is around the bore hole is generally considered as being of cylindrical shape. The radial extension of the zone invaded transversally to the bore hole may vary from several centimetres to several tens of centimetres. Said radial extension is not constant; it can vary as a function of the depth and can change over time, after the end of the drilling operation.

In order to evaluate the radial extension of the invaded zone or what is called the invasion distance, in other words the distance between the wall of the well and the end of the invaded zone, one can carry out resistivity measurements. Electrodes placed at different depths in the well are often used. One injects the current from one of the electrodes and one measures a voltage between two electrodes surrounding the electrode that has injected the current. One deduces a resistivity value from this. The further separated the electrodes are the more the measurement corresponds to a zone distant to the electrodes. By carrying out several measurements with electrodes for measuring the voltage further and further apart, one obtains several values of resistivity which, after inversion, allow the invasion distance to be deduced.

When one carries out this type of resistivity measurement, a precise knowledge of the invaded zone is not possible. One only carries out measurements in a space close to the bore hole and one deduces from these the resistivity values in the invaded zone. Said values are then generally used to correct the resistivity values taken in a zone of interest in the formation distant from the invaded zone.

One may also carry out spontaneous potential measurements between the interior of the bore hole and the infinite in order to evaluate the invasion diameter. But this method also does not enable the invasion distance to be obtained with precision.

When one wishes to analyse hydrocarbons from an oilfield from samples of fluid pumped in the well, it is useful if one knows with precision the part represented by the bore fluid in the sample and a knowledge, à priori, of the spatial limits of the invasion zone is very useful for evaluating the contamination. In fact, the oil based mud would distort the analyses if it was not taken into account.

DESCRIPTION OF THE INVENTION

The specific aim of the present invention is to propose a method for determining the position of an interface in a formation containing an electrolytic liquid in relation to a bore hole in the formation, said method not having the disadvantages mentioned hereabove.

An aim of the present invention is to be able to determine, in a precise manner, at least locally, the distance separating the bore hole and the interface.

Another aim of the present invention is to be able to determine, in a rapid manner, at least locally, the distance separating the bore hole and the interface.

A further aim of the present invention is to establish a depth profile of the interface in such a way as to obtain a true image.

In order to achieve these aims, the method according to the invention comprises the following steps:

a°) stimulating, from the bore hole, at a first depth, the interface, at a first instant with a first excitation signal corresponding to a first type of energy in such a way that said first excitation signal is converted at the level of the interface into a first response signal corresponding to a second type of energy, one of the energies being a mechanical type of energy and the other an electromagnetic type of energy, b°) detecting the first response signal at a second instant by means of a first detection device placed in the bore hole and, if the first response signal is greater than or equal to a first threshold, calculating the distance between the interface and the first detection device from the time separating the first instant and the second instant and knowing the propagation velocity of sound in the formation.

c°) at least in the case where the first response signal is less than the first threshold, detecting the first excitation signal after a reflection against the interface, at a third instant, by means of a second detection device placed in the bore hole and, if necessary, calculating the distance between the interface and the second detection device from the time separating the first instant and the third instant and knowing the propagation velocity, in the formation, of the first excitation signal.

In addition, the method may comprise the following steps:

d°) stimulating, at substantially the first depth, the interface, at a fourth instant, with a second excitation signal corresponding to the second type of energy in such a way that said second excitation signal is converted, at the level of the interface, into a second response signal corresponding to the first type of energy, e°) detecting the second response signal, at a fifth instant, by means of a third detection device placed in the bore hole and, if the second response signal is greater than or equal to a second threshold, calculating the distance between the interface and the third detection device from the time separating the fourth instant and the fifth instant and knowing the propagation velocity of sound in the formation, f°) at least in the case where the second response signal is less than the second threshold, detecting, at a sixth instant, the second excitation signal after a reflection against the interface by means of a fourth detection device placed in the bore hole and, if necessary, calculating the distance between the interface and the fourth detection device from the time separating the fourth instant and the sixth instant and knowing the propagation velocity, in the formation, of the second excitation signal.

It is possible to repeat steps a, b and, if appropriate, step c at at least one other depth in the bore hole in order to obtain a profile of the interface.

In the same way, it is possible to repeat steps d and e and, if appropriate, step f at at least one other depth in the bore hole in order to obtain a profile of the interface.

In another embodiment, it is possible to repeat steps a, b and, if appropriate, step c continuously along the length of the bore hole in such a way as to obtain a continuous profile of the interface.

In the same way, it is possible to repeat steps d and e and, if appropriate, step f continuously along the length of the bore hole in such a way as to obtain a continuous profile of the interface.

The interface having a resonance frequency, the first excitation signal and/or the second excitation signal may have a frequency that is substantially the resonance frequency of the interface.

The interface may correspond to the frontier of a zone of the formation invaded by a bore fluid injected into the bore hole.

In another embodiment, the interface may be positioned between two fluids of which at least one is electrolytic, or between two different rocky mediums of the formation or even at the level of a fracture in the formation.

The present invention also concerns a device for determining the position, in a formation containing at least one electrolytic liquid, of an interface in relation to a bore hole. It comprises:

- a first excitation device for stimulating, at a first instant, the interface with a first excitation signal corresponding to a first type of energy in such a way that said first excitation signal is converted, at the level of the interface, into a first response signal corresponding to a second type of energy, one of the energies being a mechanical type of energy and the other an electromagnetic type of energy,
- a first detection device for detecting the first response signal, at a second instant,
- first means of calculation for calculating the distance between the interface and the first detection device from the time separating the first instant and the second instant and knowing the propagation velocity of sound in the formation,
- if appropriate, firstly, a second detection device for detecting, at a third instant, the first excitation signal after a reflection against the interface and, secondly, second means of calculation for calculating the distance between the interface and the second detection device from the time separating the first instant and the third instant and knowing the propagation velocity, in the formation, of the first excitation signal.

Moreover, it may comprise:

- a second excitation device for stimulating, at a fourth instant, the interface with a second excitation signal corresponding to the second type of energy in such a way that said first excitation signal is converted at the level of the interface into a second signal,
- a third detection device for detecting the second response signal, at a fifth instant,
- third means of calculation for calculating the distance between the interface and the third detection device from the time separating the fourth instant and the fifth instant and knowing the propagation velocity of sound in the formation,
- if appropriate, firstly, a fourth detection device for detecting, at a sixth instant, the second excitation signal after a reflection against the interface and, secondly, fourth means of calculation for calculating the distance between the interface and the fourth detection device from the time separating the fourth instant and the sixth instant and knowing the propagation velocity, in the formation, of the second excitation signal.

The first excitation device may be formed by an element of a first group comprising a pressure generator, an acoustic transducer or a second group comprising at least one pair of electrodes, at least one coil, the second excitation device being formed by an element of the second group or the first group respectively.

The first detection device may be formed by an element of a group comprising at least one pair of electrodes, at least one coil or at least one acoustic sensor, the second detection device being formed by the acoustic sensor or an element of the group respectively.

In an analogous manner, the third detection device may be formed by an element of a group comprising at least one pair of electrodes, at least one coil or at least one acoustic sensor, the fourth detection device being formed by the acoustic sensor or an element of the group respectively.

In order to reduce the number of elements, the first excitation device may be merged with the second detection device.

In a similar manner, the second excitation device may be merged with the fourth detection device.

In the same aim, the first detection device may be merged with the fourth detection device.

The second detection device may be merged with the third detection device.

One may also group together, within a single calculator, the first, second, third and fourth means of calculation.

To facilitate the positioning, the first excitation device, the first detection device and the second detection device may be borne on a same support.

In the same way, the second excitation device, the third detection device and the fourth detection device may be borne on a same support. Said supports may be merged.

BRIEF DESCRIPTION OF THE DRAWINGS

The present invention will be more clearly understood on reading the description of the embodiments that are given, purely by way of indication and in nowise limitative, and by referring to the appended drawings in which.

Identical, similar or equivalent parts in the different figures described hereafter have the same number references in order facilitate going from one figure to another.

Figure 1A:
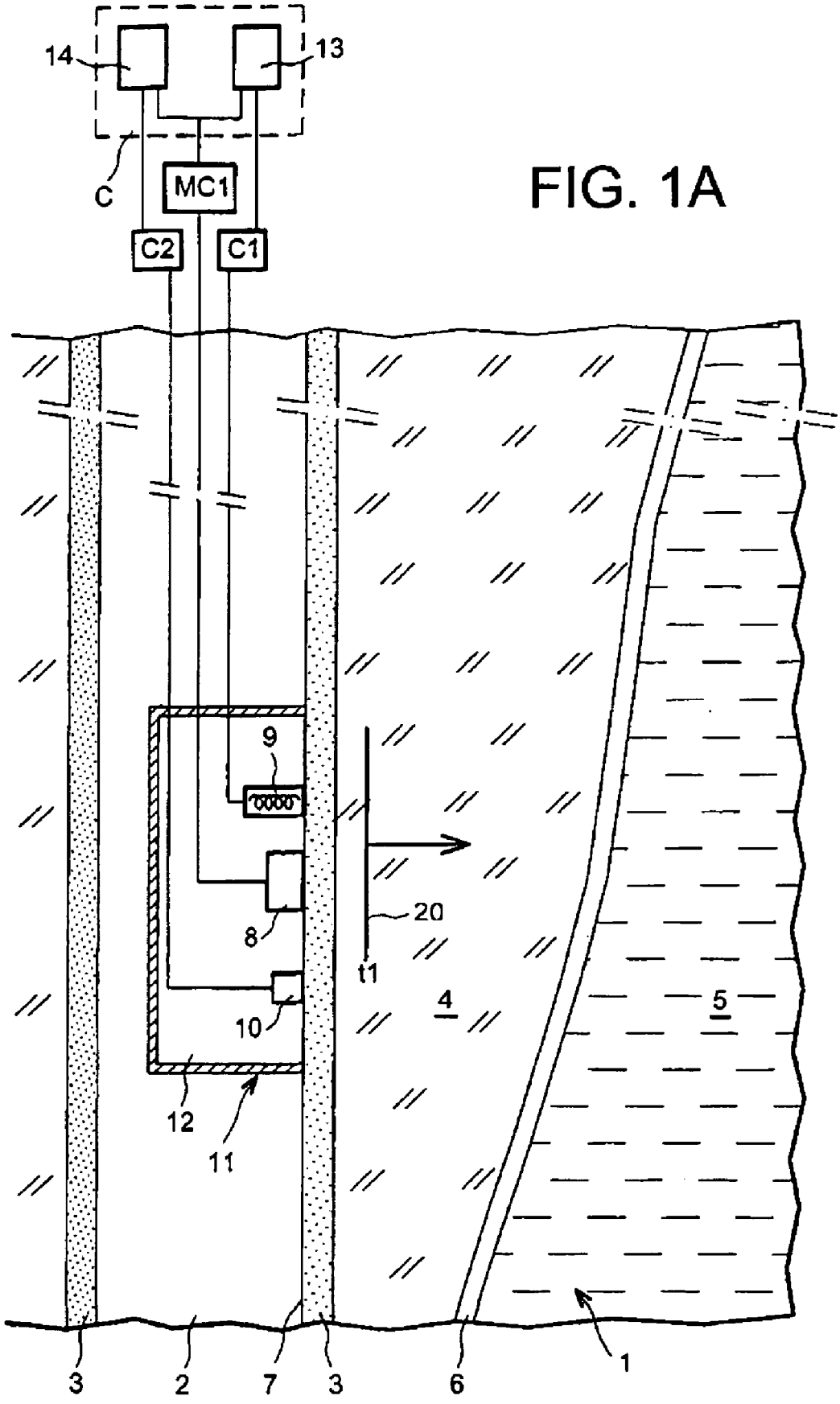
FIGS. 1A and 1B show, at different instants, a first embodiment of a positioning device according to the invention.

The different parts shown in the figures are not necessarily to a uniform scale, in order to make the figures easier to read. The spacing between excitation devices and detection devices is very small compared to the distance between the bore hole and the interface.

DETAILED DESCRIPTION OF SPECIFIC EMBODIMENTS

The method according to the invention is based on electrokinetic or electro-osmosis coupling effects. Said coupling effects may be explained in the following manner.

In a solid medium, ions of a first type belonging to the medium have a tendency to concentrate at the surface even if the medium is overall electrically neutral. A natural surface charge exists. Said charge is generally a negative charge for clayey rock. For other rocks, it is the opposite.

In a porous geological formation, in other words with solid rocky parts mixed up with porous spaces, containing at least one electrolytic fluid, the ions of the fluid having a second type opposite to the first type are attracted by the surface of the rocky parts and there is a formation of electrochemical bonds or dipoles at the rock-fluid interface. The interfacial electrochemical potential is called the Zeta potential $\xi$; this characterises the rock-fluid surface, and its value is around several tens of millivolts. There is thus a separation of the ions of the fluid, the ions of the other type of the fluid remaining in the pores.

The electrolytic fluid may be water, salty or not, a hydrocarbon such as oil or gas, but, more generally, it is a mixture of water and hydrocarbon.

When one applies a mechanical excitation signal such as an acoustic or seismic wave to the porous geological formation, said signal generates a relative movement between the fluid and the geological formation, which has the effect of modifying or breaking the electrochemical bonds, creating an electrical current density and inducing an electromagnetic field that can be measured. This phenomenon is mainly sensitive to an impedance break interface, for example at the interface between different types of rocks, at the interface between zones of different porosity and at the interface between two different types of fluid because the discontinuities reflect part of the acoustic waves. Another part of said acoustic waves is transmitted beyond the discontinuity. The layer of ions of the fluid at the surface of the rocky parts plays the role of an elastic layer that can be compared, in a sense, to the membrane of a drum.

There is therefore a conversion between an applied mechanical energy, for example in the form of an applied pressure, and a detected electromagnetic energy, for example in the form of an electrical voltage.

Conversely, when an excitation signal in the form of an electromagnetic energy is made to interact with the porous geological formation, one modifies the polarisation of the fluid in the pores, which induces seismic micro-movements in the geological formation and, more specifically, at an impedance break interface. Said induced movements may be detected by any appropriate means, for example one or several geophones, hydrophones, accelerometers, etc. There is therefore a conversion between an applied electromagnetic energy and a detected mechanical energy.

Figure 1B:
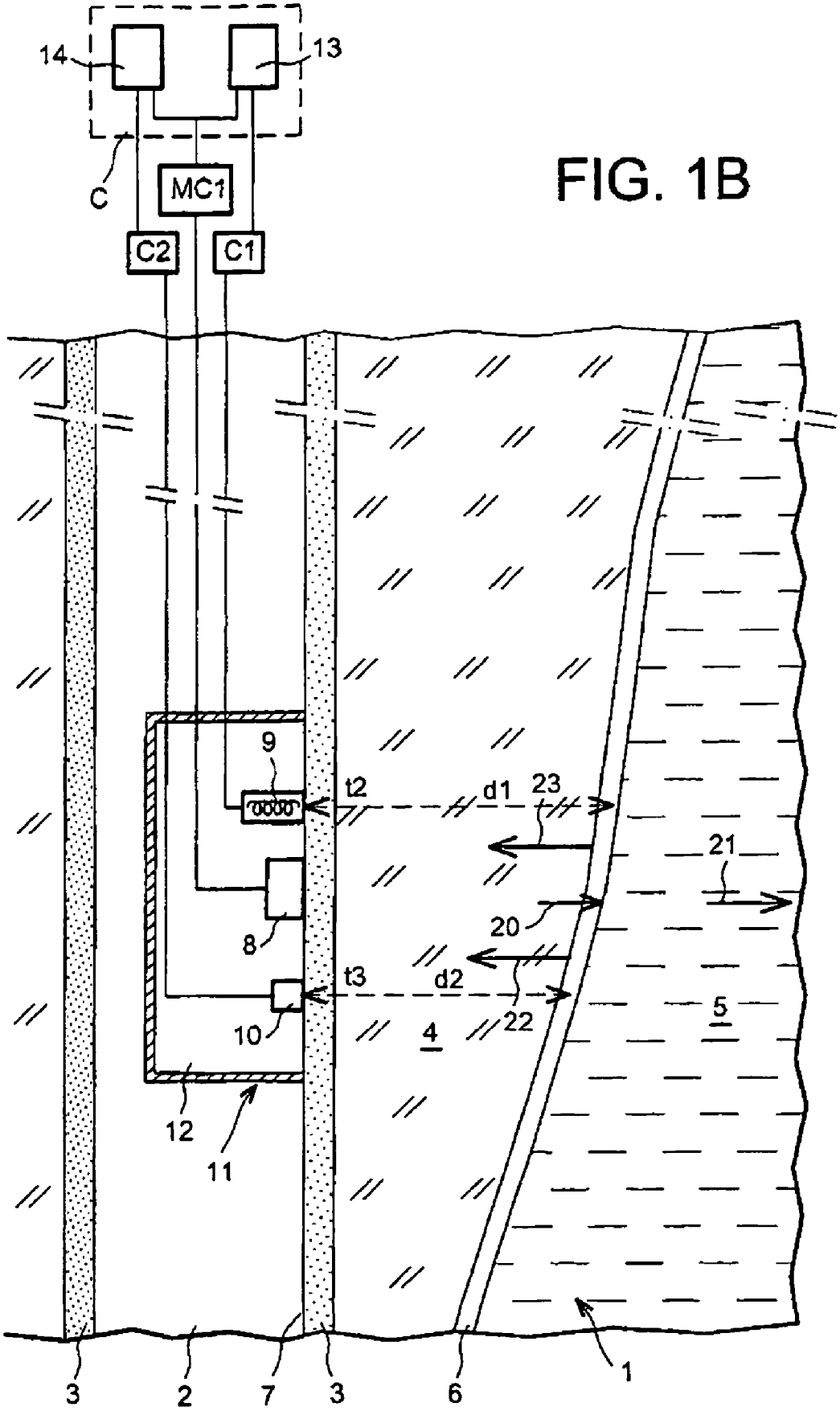

We will now refer to FIGS. 1A and 1B that show, at various instants, an embodiment of the device according to the invention used for the application of the method according to the invention. One can distinguish in this figure a porous geological formation 1, the pores of which (not represented) are saturated in fluid containing at least one electrolytic fluid. Said electrolytic fluid may be water, salty or not, a hydrocarbon such as oil or gas, or a mixture of one or several of these fluids.

A bore hole 2 has been drilled in the formation 1, while using a bore fluid during the drilling. Said bore fluid, by infiltrating into the formation 1, has formed a mud cake 3 on the interior wall 7 of the bore hole 2. On moving away substantially from the bore hole 2, one finds after the mud cake 3 a zone 4 of the geological formation 1, which has not been attacked by the drilling, but which is invaded by the bore fluid. On moving still further away from the bore hole 2, one reaches a non-contaminated zone 5. Said non-contaminated zone 5 is assumed to be saturated in electrolytic fluid. The invaded zone 4 has, from the bore hole 2, a radial extension of several centimetres to several tens of centimetres. An interface 6 exists between the invaded zone 4 and the non-contaminated zone 5 and the method according to the invention makes it possible to position, with precision, said interface in relation to the bore hole 2. Said interface 6 corresponds to the frontier of the invaded zone 4. Said interface 6 may be considered as an impedance step for certain petrophysical parameters. For example, when an aqueous bore fluid invades a layer of geological formation saturated with at least one fluid selected from water, brine, oil or gas, the penetration of the bore fluid depends on the permeability of the formation, the characteristics of the fluid of the formation 1 and the characteristics of the bore fluid. The interface 6 is a place of contrast; it may for example be a place of electrical conductivity change, of dielectric constant change, of mobility change (ratio of the permeability of the rock over the viscosity of the fluid), of acoustic impedance change (the product of the density of the fluid multiplied by the speed of the acoustic waves).

Figure 3A:
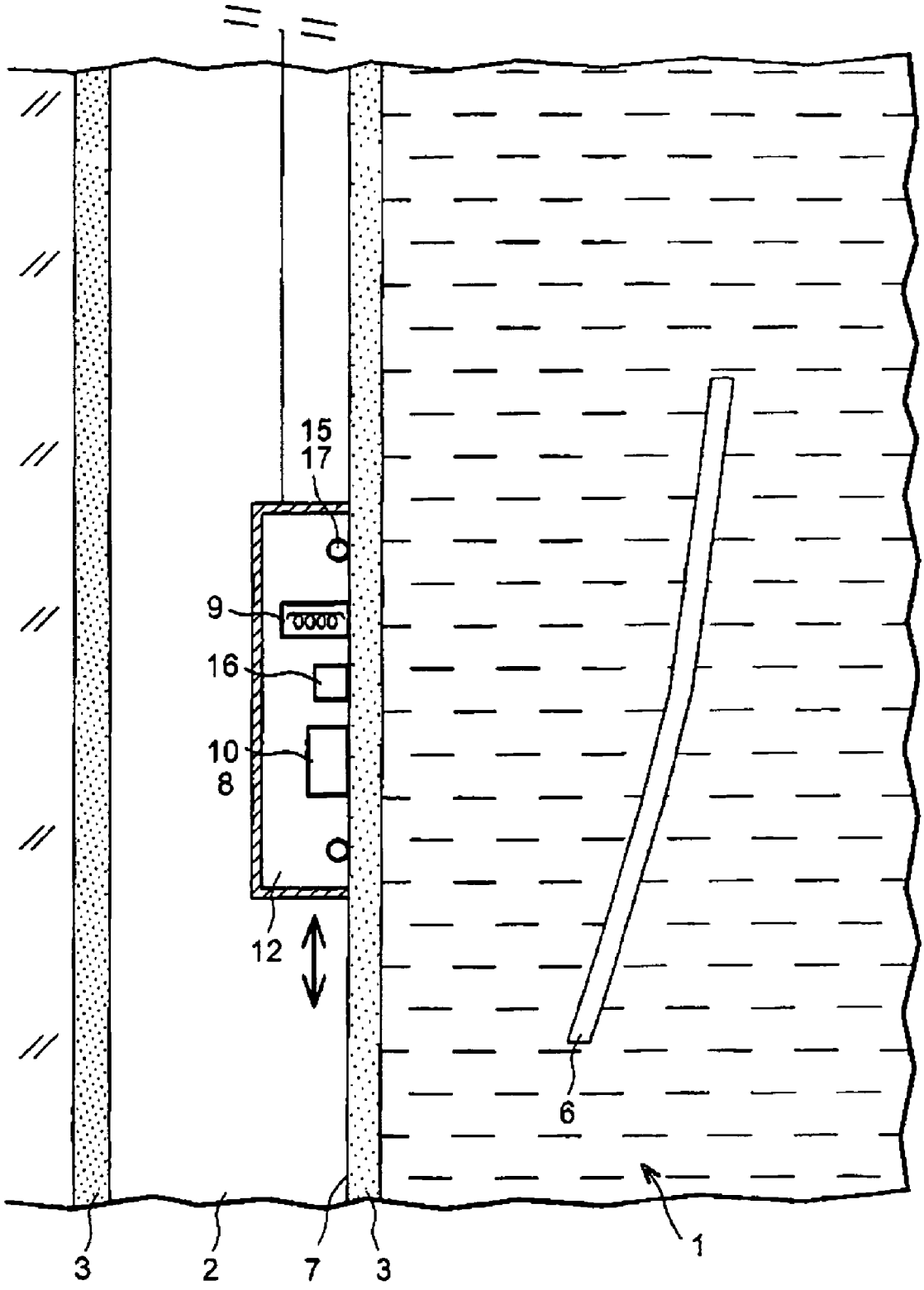
FIGS. 3A and 3B show a partial view of two further embodiments of positioning devices according to the invention.

Obviously, one could seek to determine the position of another interface 6 in the formation 1, for example situated between two fluids of the formation 1, corresponding to a fracture in the rocky formation 1 or at the frontier between two different types of rocks. This is what is illustrated in FIG. 3A.

Into the bore hole 2, which is assumed not to be lined, are lowered a first excitation device 8, a first detection device 9 and, if appropriate, a second detection device 10. These first devices 8, 9 and 10 may be part of a same tool 11 and may be assembled on a same support 12 in the form of a skid that is applied onto the wall 7 of the bore hole 2. Their mutual spacing is considered as negligible in relation to the distances that need to be detected. Their position in relation to the wall 7 depends on their nature; they may be placed against the wall 7 of the bore hole 2 or be slightly distant. The skid 12 does not need to be applied strongly against the wall 7.

The first excitation device 8 is intended to stimulate the interface 6 with a first excitation signal 20 (FIG. 1A) corresponding to a first type of energy. The first excitation device 8 emits the first excitation signal 20 at a first instant t1. The energy of a first type is a mechanical energy or an electromagnetic energy. One assumes in this first example that the first excitation signal 20 is a mechanical signal. The first excitation device 8 is then a mechanical type and may be an acoustic transducer intended to emit an acoustic signal in the formation 1 through the mud cake 3. Acoustic transducers are well known devices in seismic exploration techniques. They may be magnetostriction or piezoelectric, for example. The advantage of acoustic transducers is that they may be reversible.

In another embodiment, the first excitation device 8 could be formed, for example, by a pressure generator intended to inject a pressure signal in the formation 1 through the mud cake 3, substantially perpendicular to the wall 7 of the bore hole 2. This type of device could, for example, project a fluid under pressure against the wall 7 of the bore hole 2.

The first excitation device could also operate with electromagnetic energy. It could be similar to the second excitation device described hereafter.

In FIGS. 1A and 1B, one assumes that the first excitation device 8 is an acoustic transducer. Said device is connected to first means of control MC1, which may be placed on the surface and which excite it periodically. The frequency of the first excitation signal 20 is chosen, preferably, to be as close as possible to the resonance frequency of the interface 6. Said interface 6, which has a certain thickness, is going to enter into resonance. Its response to the excitation will be higher if it is not resonating.

The first excitation signal 20 propagates from the mud cake 3 into the invaded zone towards the interface 6. When said first excitation signal 20 arrives at the level of the interface 6, at an instant T which is not known and which is a function of the sought after distance between the interface 6 and the bore hole 2, a part 21 of the first excitation signal 20 is transmitted beyond the interface 6, a part 22 is reflected and, due to the phenomenon of electrokinetic coupling, an electrical field is induced. Said electrical field corresponds to a first response signal 23. The references 21, 22 and 23 are illustrated in FIG. 1B. The principal component of the electromagnetic field is radiated in a direction substantially normal to the interface 6 and propagates on either side of the interface 6 at the propagation velocity of electromagnetic waves in the medium.

The first detection device 9 is intended to detect the first response signal 23. Said detection can only occur if the first response signal 23 has a sufficient level, in other words if it is greater than or equal to a first threshold. Said first threshold depends on the sensitivity of the first detection device 9. Said detection occurs at a second instant t2, which can then itself be measured.

The first detection device 9 can detect the electrical component of the induced electromagnetic field or instead its magnetic component. One assumes that in the example in FIGS. 1A and 1B it detects its magnetic component and that it is formed by at least one coil placed near to the wall 7 of the bore hole 2 (not necessarily in contact with the wall), oriented with its coil axis substantially normal to the wall 7 of the bore hole 2 or even substantially vertical. If one uses several coils, they can be mounted in a network. In the presence of the magnetic component of the electromagnetic field, a current is induced in the coil and said current may be collected by any appropriate means. The coil may, for example, be electrically connected to a first processing circuit C1, which may be placed on the surface. The processing circuit may comprise an amplifier, for example.

In order to detect the electrical component, one could use at least one pair of electrodes, spaced apart from each other, electrically connected to the first processing circuit C1. Said pair of electrodes may be substantially vertical or azimuthal in the bore hole 2. With said pair of electrodes, one will detect a voltage that is collected by the first processing circuit C1. Using a network of electrodes would also be possible.

One also provides means of calculation 13 for calculating the distance d1 between the interface 6 and the first detection device 9. The calculation is made from the time separating the second instant t2 and the first instant t1 and the propagation velocity Vp of sound in the formation 1. This velocity is determined otherwise, for example in a conventional manner, for example by means of sonic or acoustic tools.

The first means of calculation 13 may be included in a calculator C that is connected to the first processing circuit C1 and to the first means of control MC1 to acquire the first instant t1 and the second instant t2.

The distance d1 between the interface 6 and the first detection device 9 is substantially equal to: $d1=(t2-t1)/Vp$ since the time t2−T and the space between the first excitation device 8 and the first detection device 9 are considered as negligible.

It may be that, depending on the nature of the mediums situated on either side of the interface 6, the first response signal 23 is too weak to be detected by the first detection device 9. This may occur for example if the interface 6 corresponds to a fault or fracture in the homogenous rocky medium saturated with a single fluid or if the bore fluid is oily mud and the formation 1 is saturated in gas. One then has a low electromagnetic contrast.

Conversely, when there is no gas at the interface 6, the acoustic impedance contrast is low. The acoustic impedance contrast represents the transfer of energy between two mediums. It is high for example at a gas-liquid interface.

The fact of not being able to detect with precision the first response signal 23 is not without interest, as one could believe; it gives indications on the type of rocks in the formation 1 and/or on the fluid(s) that they contain.

As a consequence, the device for determining the position of an interface 6 according to the invention may provide in addition, firstly, a second detection device 10 for detecting, at a third instant t3, the first excitation signal 22 reflected by the interface and, secondly, second means of calculation 14 for calculating the distance d2 between the interface 6 and the second detection device 10 from the time separating the first instant t1 and the third instant t3 and the propagation velocity of the first excitation signal 20 in the formation 1. A second processing circuit C2 is provided between the second detection device 10 and the second means of calculation 14. It may be analogous to the first processing circuit.

The second means of calculation 14 may be included in the calculator C which is also connected to the second processing circuit C2 and to the first means of control MC2 in order to acquire the first instant t1 and the third instant t3.

The distance d2 between the interface 6 and the second detection device 10 is substantially equal to: $d2=(t3-t1)/2V$. V represents the propagation velocity of the first excitation signal 20 in the formation 1. In the example of FIGS. 1A and 1B, in which the first excitation device 8 and the second detection device 10 are mechanical, V is equal to the velocity of sound Vp. The two distances d1 and d2 are substantially equal since one assumes that the distance between the first detection device 9 and the second detection device 10 is negligible.

In certain cases, it is judicious to carry out two distance calculations even if the first distance calculation is significant. This increases the precision of the positioning.

The second detection device 10, in the case of FIGS. 1A and 1B, may be formed by an acoustic sensor, for example of the hydrophone or geophone type. When the first excitation device 8 is the acoustic transducer type, it may also serve the second detection device 10. The second detection device 10 is then merged with the first excitation device 8. A piezoelectric transducer detects mechanical vibrations in electrical form.

In FIGS. 1A and 1B, the first excitation device 8, formed by an acoustic transducer, is located in the central part of the skid 12, the second detection device 10, formed by a geophone or hydrophone, is located on one side of the first excitation device 8 and the first detection device 9, formed by a coil, is located on the other side of the first excitation device 8.

When one wishes to establish a profile of the interface 6, one carries out such detections several times, at different depths. Said detections may be discrete, but since the detection devices have a very short acquisition time, for example of around several milliseconds, it is possible to carry out detections in a continuous manner during a single pass of the skid 12 in the bore hole 2.

In order to further improve the precision of the positioning of the interface 6, it is possible to provide, in an additional manner, a second excitation device 15, a third detection device 16 and, if appropriate, a fourth detection device 17. Said three devices 15, 16 and 17 are comparable to those described previously apart from the fact that they operate with energies of a type opposite to those of the first excitation device 8, the first detection device 9 and the second detection device 10 respectively.

The second excitation device 15 is intended to stimulate the interface 6 with a second excitation signal 30 (FIG. 2A), corresponding to the second type of energy and no longer the first type. The second excitation device 15 emits the second excitation signal 30 at a fourth instant t4.

In the same manner as previously, the second excitation signal 30 propagates from the mud cake 3 into the invaded zone 4 towards the interface 6. When said second excitation signal 30 arrives at the level of the interface 6, at an instant T' that is not known and which is a function of the sought after distance between the interface 6 and the bore hole 2, a part 31 of the second excitation signal is transmitted beyond the interface 6, a part 32 is reflected and, due to the phenomenon of electrokinetic coupling, an electromagnetic field is induced. Said electromagnetic field corresponds to a second response signal 33. The references 31, 32 and 33 are illustrated in FIG. 2B.

In this example, the second excitation signal 30 is electromagnetic and the second excitation device 15 may take the form of at least one coil in which one circulates, at the fourth instant t4, an alternative, pulsed or similar periodic current. The circulation of this current is controlled by the second means of control MC2 which may be located on the surface. This coil, located near to the wall 7 of the bore hole 2 and suitably oriented, for example with its coil axis substantially vertical or normal to the wall 7 of the bore hole 2. One could provide several coils assembled in a network.

In another embodiment, the second excitation device 15 could comprise at least one pair of electrodes from which one may inject, in the mud cake 3, at the fourth instant t4, an alternative, pulsed or similar periodic current. They could be placed against the wall 7 of the bore hole 2 and could be separated from each other. The pair of electrodes may be substantially vertical or azimuthal. They could be connected to an appropriate power source via the second means of control MC2. More than two electrodes could be used, and they could be assembled in a network.

Obviously, the second excitation device could operate with a mechanical energy and could be similar to the first excitation device.

With such a second excitation device 15, the third detection device 16 could, for example, be acoustic, formed by at least one hydrophone or geophone for example, placed in contact with the wall 7 of the bore hole 2. In the same way, the third detection device 16 is connected to a third processing circuit C3 which may be located on the surface. It may be analogous to the first processing circuit.

The third detection device 16 is intended to detect the second response signal 33. Said detection happens at a fifth instant t5 which can itself be measured. If said second response signal 33 is sufficient, in other words greater or equal to a second threshold, one is able to calculate the distance d3 between the interface 6 and the third detection device 16. Said second threshold depends on the sensitivity of the third detection device.

In order to calculate the distance, one provides third means of calculation 18 for calculating the distance d3 from the time separating the fifth instant t5 and the fourth instant t4 and the propagation velocity Vp of sound in the formation 1. The distance d3 between the interface 6 and the third detection device 16 is substantially equal to: $d3=(t5-t4)/Vp$ since the time interval $T'-t3$ is considered as negligible.

The third means of calculation 18 may be included in the calculator C which is also connected to the third processing circuit C3 and to the second means of control MC2 in order to acquire the fourth instant t4 and the fifth instant t5.

The fourth detection device 17 is intended to detect, at a sixth instant t6, the second excitation signal 32 reflected by the interface 6.

In this example, the fourth detection device 17 could be electromagnetic, formed for example by at least one pair of electrodes e1 and e2. At least one coil could be used.

In the same way, the fourth detection device 17 is connected to a fourth processing circuit C4 which may be located on the surface. It may be analogous to the first processing circuit.

In addition, one could provide fourth means of calculation 19 for calculating the distance d4 between the interface 6 and the fourth detection device 17, from the time separating the fourth instant t4 and the sixth instant t6 and the propagation velocity V of the second excitation signal 30. In this case, said velocity V is the propagation velocity of electromagnetic waves in the medium. The distance d4 between the interface 6 and the fourth detection device is substantially equal to : $d4=(t6-t4)/2V$. This measurement would require very short sampling and discriminating times.

The fourth means of calculation 19 could be included in the calculator C which is also connected to the fourth processing circuit C4 and to the second means of control MC2 in order to acquire the fourth instant t4 and the sixth instant t6.

By means of the second excitation device 15 and the third and fourth detection devices 16 and 17, one can also take measurements at several depths, said measurements being either discrete or continuous.

Figure 2A:
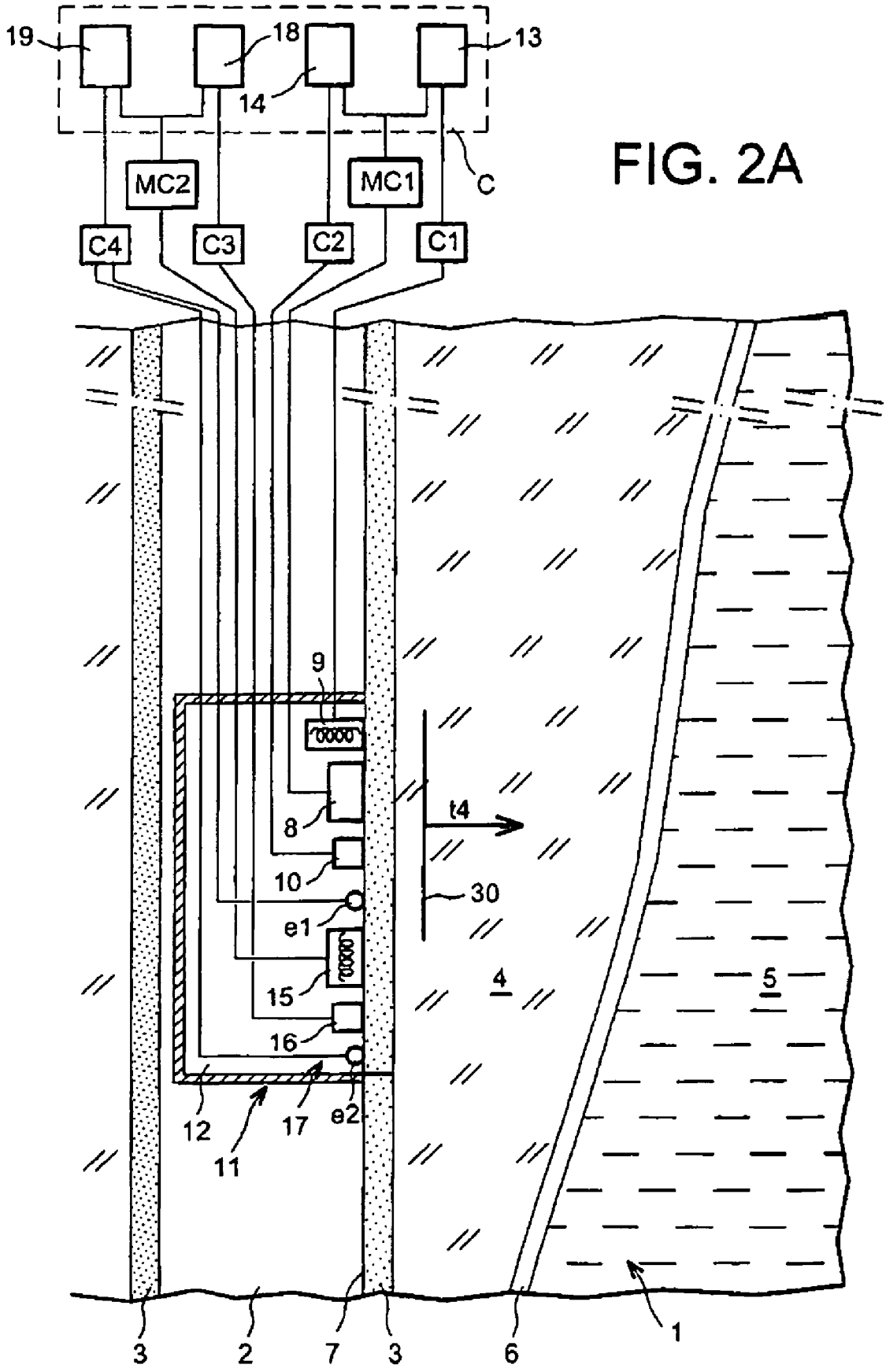
FIGS. 2A and 2B show, at different instants, a second embodiment of a positioning device according to the invention.
Figure 2B:
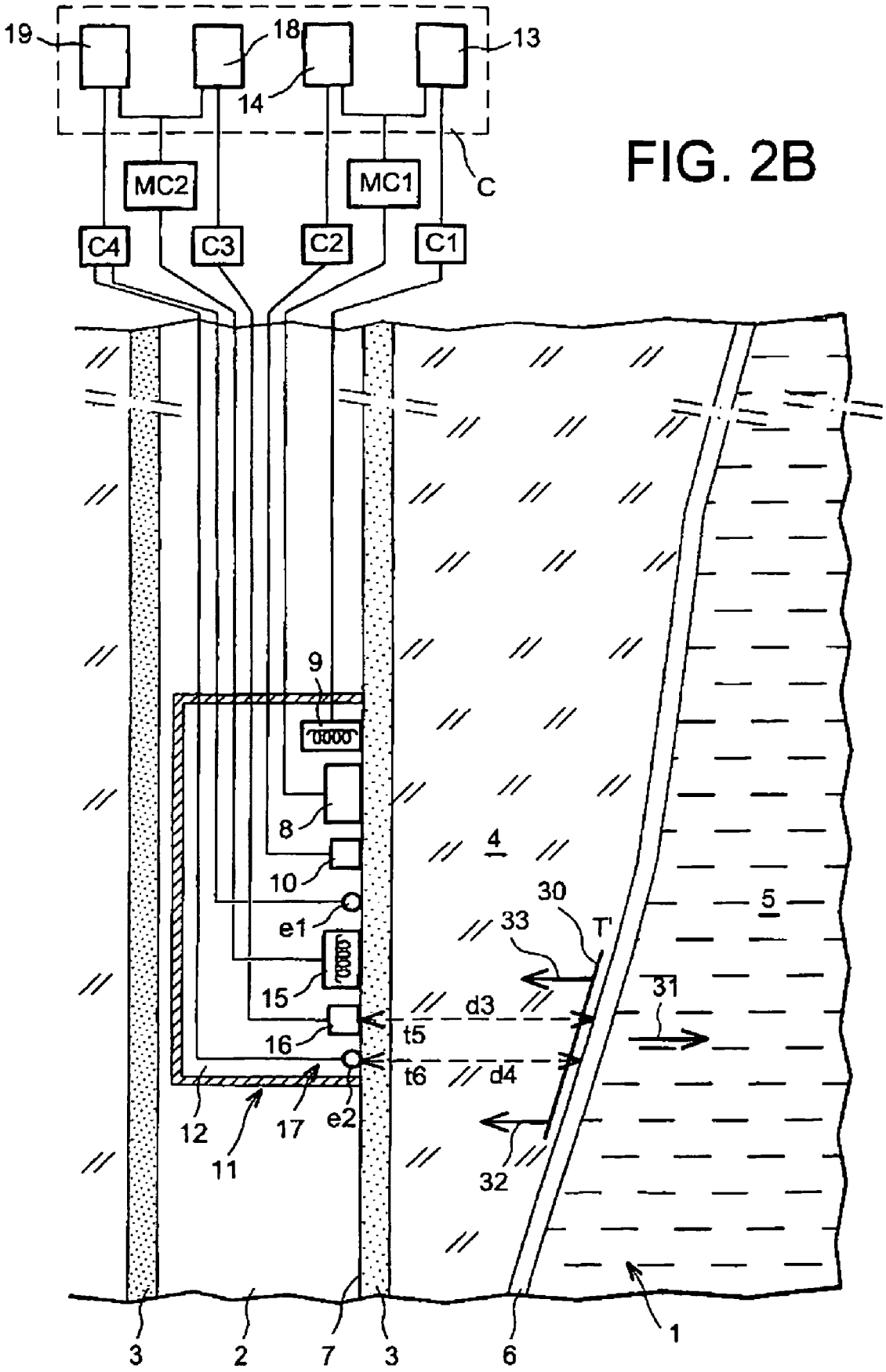

In FIGS. 2A and 2B, the first excitation device 8, the second excitation device 15 and the four detection devices 9, 10, 16 and 17 have been represented as distinct. It is possible for this not to be the case, as in FIGS. 3A and 3B. The excitation devices 18 and 15 operate successively and the detections are also successive. This configuration makes it possible to economise components and thus to reduce costs.

The first excitation device 8 may be merged with the second detection device 10. The second excitation device 15 may be merged with the fourth detection device 17. FIG. 3A illustrates this configuration. In this figure, the processing circuits, the means of control and the means of calculation have not been represented in order not to clutter up the figure. All of the means of calculation 13, 14, 18 and 19 may be grouped together within a single calculator.

Figure 3B:
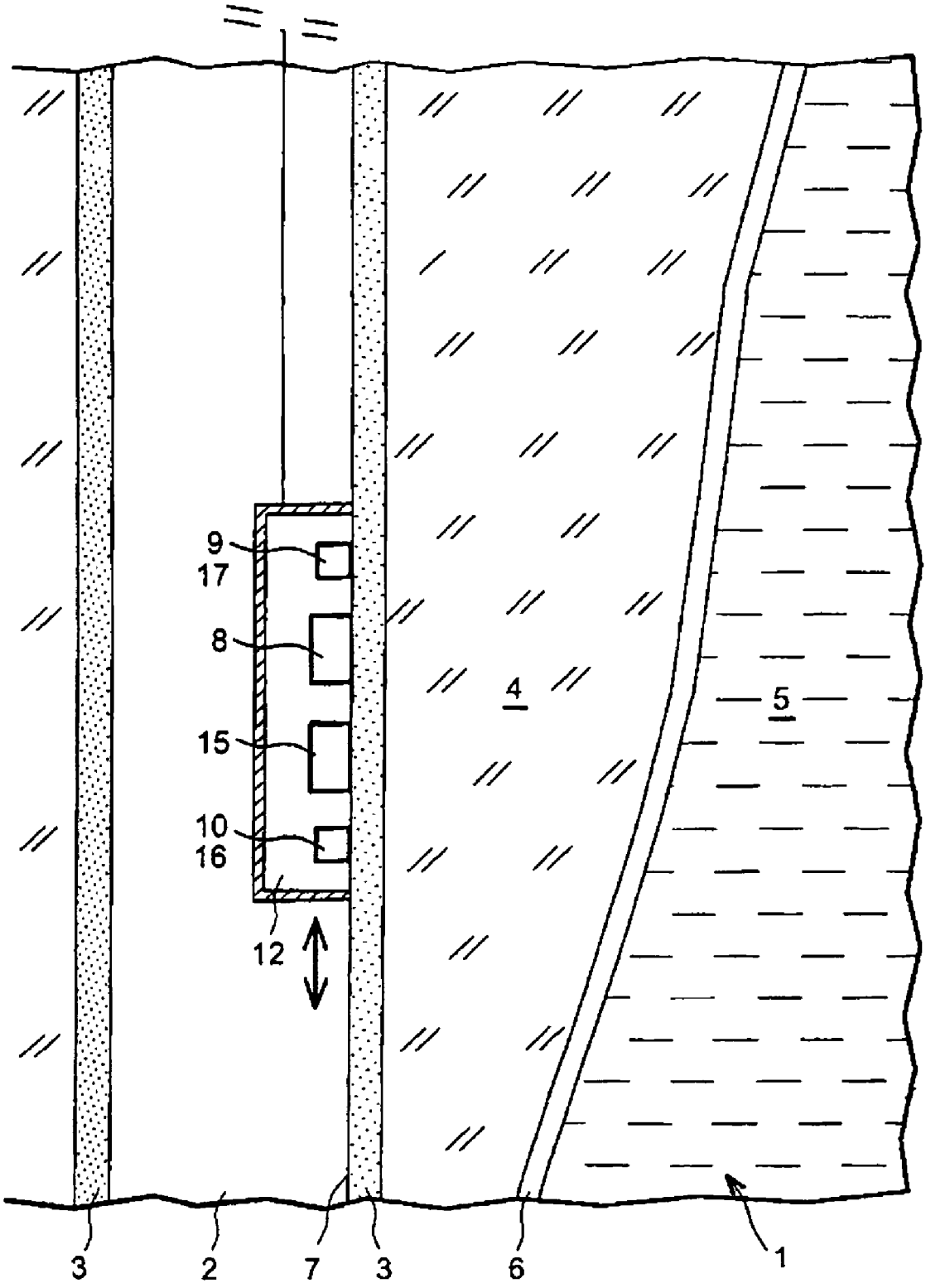

FIG. 3B shows that the first detection device 9 is merged with the fourth detection device 17 and that the second detection device is merged with the third detection device 16.

The device thus described is reversible at the level of the first and second excitation devices as well as at the level of the first and third detection devices and the second and fourth detection devices.

By having available a device that, at a given point of the bore hole 2, is capable of carrying out at least one pair of measurements by means of signals corresponding to the two types of energy, one can better evaluate the position of the interface 6 and the characteristics of the formation 1 on either side of said interface 6. With the measurements taken from two excitation devices of different type, the results are even better. This allows one to verify by cross-checking the measured distance and to increase the range of distances that can be detected.

Although several embodiments of the present invention have been represented and described in a detailed manner, it will be understood that various changes and modifications may be made without going beyond the scope of the present invention, especially as regards the structures of the excitation devices and detection devices.

The invention claimed is:

1. Method for determining the position, in a formation (1) containing at least one electrolytic liquid, of an interface (6) in relation to a bore hole (2), comprising the following steps:

a°) stimulating, from the bore hole (2) at a first depth, the interface (6), at a first instant (t1), with a first excitation signal (20) corresponding to a first type of energy in such a way tat said first excitation signal (20) is converted at the level of the interface (6) into a first response signal (23) corresponding to a second type of energy, one of the energies being a mechanical type of energy and the other an electromagnetic type of energy, b°) detecting the first response signal (23) at a second instant (t2) by means of a first detection device (9) placed in the bore hole (2) and, if the first response signal (23) is greater than or equal to a first threshold, calculating the distance (d1) between the interface (6) and the first detection device (9) from the time separating the first instant (t1) and the second instant (t2) and knowing the propagation velocity (Vp) of sound in the formation (1), c°) at least in the case where the first response signal (23) is less than the first detection threshold, detecting the first excitation signal (20) after a reflection against the interface (6) at a third instant (t3) by means of a second detection device (10) placed in the bore hole (2) and calculating the distance (d2) between the interface (6) and the second detection device (10) from the time separating the first instant (t1) and the third instant (t3) and knowing the propagation velocity (V), in the formation (1), of the first excitation signal (20).

2. Positioning method according to claim 1, comprising the following steps:

d°) stimulating, at substantially the first depth, the interface (6), at a fourth instant (t4), with a second excitation signal (30) corresponding to the second type of energy in such a way that said second excitation signal (30) is converted at the level of the interface (6) into a second response signal (33) corresponding to the first type of energy, e°) detecting the second response signal (33), at a fifth instant (t5), by means of a third detection device (16) placed in the bore hole (2) and, if the second response signal (33) is greater than or equal to a second threshold, calculating the distance (d3) between the interface (6) and the third detection device (16) from the time separating the fourth instant (t4) and the fifth instant (t5) and knowing the propagation velocity (Vp) of sound in the formation (1), f°) at least in the case where the second response signal (32) is less than the second threshold, detecting, at a sixth instant (t6), the second excitation signal (32) after a reflection against the interface (6) by means of a fourth detection device (17) placed in the bore hole (2) and calculating the distance (d4) between the interface (6) and the fourth detection device (17) from the time separating the fourth instant (t4) and the sixth instant (t6) and knowing the propagation velocity (V), in the formation (1), of the second excitation signal (30).

3. Method according to claim 2, consisting in repeating steps a, b and c at at least one other depth in the borehole (2) in order to obtain a profile of the interface (6).

4. Method according to claim 3, consisting in repeating steps d, e and f at at least one other depth in the bore hole (2) in order to obtain a profile of the interface (6).

5. Method according to claim 2, consisting in repeating steps a, b and c continuously along the length of the borehole (2) in such a way as to obtain a continuous profile of the interface (6).

6. Method according to claim 2, consisting in repeating steps d, e and f continuously along the length of the borehole (2) in such a way as to obtain a continuous profile of the interface (6).

7. Method according to claim 1 wherein it consists in repeating steps a, b and c at at least one other depth in the bore hole (2) in order to obtain a profile of the interface (6).

8. Method according to claim 2, wherein it consists in repeating steps d and e and f at at least one other depth in the borehole (2) in order to obtain a profile of the interface (6).

9. Method according to claim 1, wherein it consists in repeating steps a, b and c continuously along the length of the bore hole (2) in such a way as to obtain a continuous profile of the interface (6).

10. Method according to claim 2, wherein it consists in repeating steps d, and e and f continuously along the length of the bore hole (2) in such a way as to obtain a continuous profile of the interface (6).

11. Method according to claim 1, in which the interface (6) has a resonance frequency, wherein the first excitation signal (20) and/or the second excitation signal (30) has a frequency that is substantially the resonance frequency of the interface (6).

12. Method according to claim 1, wherein the interface (6) corresponds to the frontier of a zone of the formation invaded by a bore fluid injected into the bore hole (2).

13. Method according to claim 1, wherein the interface (6) is positioned between two fluids of which at least one is electrolytic, or two different rocky mediums of the formation (1), at the level of a fracture in the formation (1).

14. Device for determining the position, in a formation (1) containing at least one electrolytic liquid, of an interface (6) in relation to a bore hole (2), wherein it comprises:

a first excitation device (8) for stimulating, at a first instant (t1), the interface (6) with a first excitation signal (20) corresponding to a first type of energy in such a way that said first excitation signal (20) is converted at the level of the interface (6) into a first response signal (23) corresponding to a second type of energy, one of the energies being a mechanical type of energy and the other an electromagnetic type of energy, a first detection device (9) for detecting the first response signal (23) at a second instant (t2), first means of calculation (13) for calculating the distance (d1) between the interface (6) and the first detection device (9) from the time separating the first instant (t1) and the second instant (t2) and knowing the propagation velocity (Vp) of sound in the formation (1), firstly, a second detection device (10) for detecting at a third instant (t3) the first excitation signal (20) after a reflection against the interface (6), and, secondly, second means of calculation (14) for calculating the distance (d2) between the interface (6) and the second detection device (10) from the time separating the first instant (t1) and the third instant (t3) and knowing the propagation velocity (V), in the formation (1), of the first excitation signal (20).

15. Device according to claim 14 comprising:

a second excitation device (15) for stimulating, at a fourth instant (t4), the interface (6) with a second excitation signal (30) corresponding to the second type of energy in such a way that said first excitation signal (30) is converted at the level of the interface (6) into a second signal, a third detection device (16) for detecting the second response signal (33) at a fifth instant (t5), third means of calculation (18) for calculating the distance (d3) between the interface (6) and the third detection device (16) from the time separating the fourth instant (t4) and the fifth instant (t5) and knowing the propagation velocity (Vp) of sound in the formation (1), firstly, a fourth detection device (17) for detecting, at a sixth instant (t6), the second excitation signal (30) after a reflection against the interface (6) and, secondly, fourth means of calculation (19) for calculating the distance (d4) between the interface (6) and the fourth detection device (17) from the time separating the fourth instant (t4) and the sixth instant (t6) and knowing the propagation velocity (V), in the formation (1), of the second excitation signal (30).

16. Device according to claim 15, wherein the second excitation device (15) is merged with the fourth detection device (17).

17. Device according to claim 15, wherein the first detection device (9) is merged with the fourth detection device (19).

18. Device according to claim 15, wherein the second detection device (10) is merged with the third detection device (16).

19. Device according to claim 15, wherein the first, second, third and fourth means of calculation are grouped together within a single calculator (C).

20. Device according to claim 15, wherein the interface (6) having a resonance frequency, the first excitation signal (20) and/or the second excitation signal (30) has a frequency that is substantially the resonance frequency of the interface (6).

21. Device according to claim 15, wherein the second excitation device (15), the third detection device (16) and the fourth detection device (17) are borne on a same support (12).

22. Device according to claim 21, wherein the supports are merged.

23. Device according to claim 15, wherein the first excitation device (10) is formed by an element of a first group comprising a pressure generator, an acoustic transducer or a second group comprising at least one pair of electrodes, at least one coil, the second excitation device being formed by an element of the second group or the first group respectively.

24. Device according to claim 14, wherein the first detection device (9) is formed by an element of a group comprising at least one pair of electrodes, at least one coil or at least one acoustic sensor and in that the second detection device (10) is formed by the acoustic sensor or by an element of the group respectively.

25. Device according to claim 14, wherein the third detection device (16) is formed by an element of a group comprising at least one pair of electrodes, at least one coil or at least one acoustic sensor and in tat the fourth detection device (17) is formed by the acoustic sensor or by an element of the group respectively.

26. Device according to claim 14, wherein the first excitation device (8) is merged with the second detection device (10).

27. Device according to claim 14, wherein the first excitation device (8), the first detection device (9) and the second detection device (10) are borne on a same support (12).

28. Device according to claim 27, wherein the supports are merged.

* * * * *